US007174684B2

(12) United States Patent
Nuetzel et al.

(10) Patent No.: US 7,174,684 B2
(45) Date of Patent: Feb. 13, 2007

(54) CORROSION-RESISTANT TENSION MEMBER, PARTICULARLY A TENDON FOR PRESTRESSED CONCRETE

(75) Inventors: Oswald Nuetzel, Munich (DE); Egbert Zimmermann, Haar (DE)

(73) Assignee: Dywidag-Systems International GmbH, Aschheim (DE)

( * ) Notice: Subject to any disclaimer, the term of this patent is extended or adjusted under 35 U.S.C. 154(b) by 213 days.

(21) Appl. No.: 10/902,835

(22) Filed: Aug. 2, 2004

(65) Prior Publication Data

US 2005/0034392 A1 Feb. 17, 2005

(30) Foreign Application Priority Data

Aug. 2, 2003 (DE) ..... 203 11 950 U

(51) Int. Cl.
*E04C 5/08* (2006.01)

(52) U.S. Cl. ..... 52/223.13; 52/223.14; 52/231

(58) Field of Classification Search ..... 52/223.13, 52/231, 223.14; 14/22
See application file for complete search history.

(56) References Cited

U.S. PATENT DOCUMENTS 4,878,327 A * 11/1989 Nutzel et al. ..... 52/223.13
6,578,329 B1 6/2003 Stubler et al.
2002/0088105 A1* 7/2002 Nutzel ..... 29/452

FOREIGN PATENT DOCUMENTS

| | | | |
|---|---|---|---|
| DE | 37 34 954 | A1 | 4/1988 |
| DE | 36 44 551 | A | 7/1988 |
| DE | 38 31 518 | A1 | 4/1990 |
| DE | 41 18897 | A1 | 12/1992 |
| EP | 0 323 285 | A1 | 7/1989 |
| EP | 0 703 326 | A1 | 3/1996 |
| WO | WO 99/36641 | | 7/1999 |
| WO | WO 01/20098 | A1 | 3/2001 |

* cited by examiner

*Primary Examiner*—Naoko Slack
*Assistant Examiner*—Chi Q. Nguyen
(74) *Attorney, Agent, or Firm*—McGrath, Geissler, Olds & Richardson, PLLC

(57) ABSTRACT

A corrosion-resistant tension member, particularly a tendon for prestressed concrete, comprising a bundle of tension elements arranged inside a sheathing, has at its ends anchoring devices each with an anchor plate. On the side of the anchor plate facing away from the open air side, a seal having tension elements running through it and having a sealing plate are arranged, the sealing plate being fixed in place on the side facing away from the anchor plate opposite the anchor body against longitudinal displacement. Between the anchor plate and a pressure plate butting against the sealing plate, pressure-transferring means, for example, a pressure tube, are provided, having a length calculated in such a way that a longitudinal displacement of the anchor plate that occurs when the tension elements are being tensioned, actuates the exertion of surface pressure to the sealing plate for activating the seal.

22 Claims, 2 Drawing Sheets

CORROSION-RESISTANT TENSION MEMBER, PARTICULARLY A TENDON FOR PRESTRESSED CONCRETE

This nonprovisional application claims priority under 35 U.S.C. § 119(a) on German Patent Application No. DE 203 11 950.9 filed in Germany on Aug. 2, 2003, which is herein incorporated by reference.

BACKGROUND OF THE INVENTION

1. Field of the Invention

The invention relates to a corrosion-resistant tension member, particularly a tendon for prestressed concrete.

2. Description of the Background Art

In the construction of buildings with prestressed concrete, bonded or unbonded prestressing is commonly known. With bonded prestressing, the tendons are located longitudinally movable within the concrete cross section and, after tensioning against the hardened concrete, are bonded to the surrounding concrete by injecting cement paste. With unbonded prestressing, the tendons are most often located outside of the concrete cross section, however, they are supported against a structure; in this way, they can be inspected, re-tightened, and if necessary replaced at any time.

With tension members of this kind, so-called monostrands are frequently used as tension elements, that is, strands made of seven steel wires, each being enclosed by a plastic sheath, for example, polyethylene, that is applied by extrusion, to protect against corrosion, and which are embedded in a corrosion-protection substance, for example, grease, which fills wedges between the steel wires and a ring space between the strand and the sheath; also known are strands that are enclosed by two sheaths of this kind, for reinforced protection against corrosion.

The anchorage of the strands at the ends of the tendons usually includes anchoring discs made of steel, with conical, and subsequently cylindrical bores in the number of strands, through which these are threaded and in which they are anchored with multiple-part ring wedges. To anchor the strands, it is, however, necessary to remove the sheaths from the strands in the area of the anchorage, so that the anchorage wedges can directly grip the bare strand.

For reasons of corrosion protection, the hollow spaces in the anchorage areas, where the sheaths were removed from the strands, must be filled with a material, for example, grease, to insure protection against corrosion. When the hollow spaces between the individual strands in the areas of the tendons in between the anchorings are filled in at their ends with a hardened material, for example, mortar, to safeguard against corrosion, it is necessary to tightly delimit the anchorage areas that are to be filled with corrosion-resistant materials from those areas.

To separate the anchorage areas, which are to be filled in with corrosion-resistant materials, of a tension member from the free areas, it is known to use sealing elements made of an elastic material around the individual sheathed strands, the sealing elements being brought to a transverse extension by a surface pressure in an axial direction of the tendon, to tightly seal off the individual strands and an interior wall of the outer sheathing. Seals such as these, designed somewhat like a compression gland, are known from EP 0 323 285 B2 and WO 01/20098 A1. In there, to activate the seals, pressure is applied to the sealing elements embedded between pressure plates by bolts that can be actuated from the exposed side of the anchor plate. This type of activation of the seals, however, necessitates a lot of effort.

If signs of corrosions appear on the individual strands despite all safety measures, their tension must be decreased to replace them. To do this, the bolts, which compress the seals between the pressure plates, must be loosened prior to loosening the ring wedges of the strands. Due to deformations that took place, the sealing parts frequently cannot be returned to their original position without additional expenditure of energy. Thus, the entire anchor plate has to be dismantled in order to replace individual strands to avoid the risk of damaging the deformed sealing elements and/or the sheaths of the strands when the strands are pulled.

Unbonded tendons, which traditionally have been used basically as external tendons, that is, tendons guided outside the concrete cross section, are increasingly also used as internal tendons, that is, tendons guided inside the concrete cross section. As tendons arranged inside the concrete cross-section they have an advantage from a static view point, namely, with regard to a lever arm of internal forces that can be utilized. Moreover, the tension can be controlled by re-tightening, which is not possible with bonded pre-loading. Lastly, this type of tendons allows replacement of individual tension members as well as the entire bundle.

Particularly advantageous compared to external tendons is the fact that the tendons are embedded in concrete so that reversing forces at reversing points can be absorbed without taking any particular measures. For this purpose, strands with reinforced sheaths or twice-extruded strands are also frequently used.

SUMMARY OF THE INVENTION

It is therefore an object of the invention to provide a simpler and more economical means for a seal of the anchoring area of a tension member of this kind, particularly for the use as unbonded tendons, which allows not only for easy installation but also for a more simplified replacement of individual strands as well as the opportunity to used twice-extruded strands.

The invention is based on the idea to avoid the activation of the compression gland-like seal of the anchoring area by additional steps like screw bolts, which are actuated from an open air side of the anchoring, or such. Rather, according to the invention, the seal is activated in a simple way in that the anchor plate is held at a predetermined distance from the anchor body by a pressure-transferring means during the installation of the tension member, and that the longitudinal displacement of the anchor plate in the direction of the anchor body, which is caused by the tensioning of the tension member, is by applying a required surface pressure via the pressure-transferring means to the sealing element, which in turn is fixed in place to prevent longitudinal displacement.

It is thereby beneficial that the perforated disk that is provided as a spacer for the individual tension elements also serves as an abutment for the sealing plate, which can be made of, for example, soft rubber or foamed material. However, in this circumstance, a longitudinal displacement of the perforated disk is avoided by an abutment on the tube-shaped part of the anchor body. This can be accomplished with suitable types of stops on the interior wall of the anchor body. If necessary, a steel plate for creating a three-dimensional state of tension can be inserted between the perforated disks. Due to the transverse deformation of the sealing element thus activated, the hollow space is reliably sealed off to the PE sheaths of the strands as well as to the interior wall of the anchor body as an exterior sheath.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
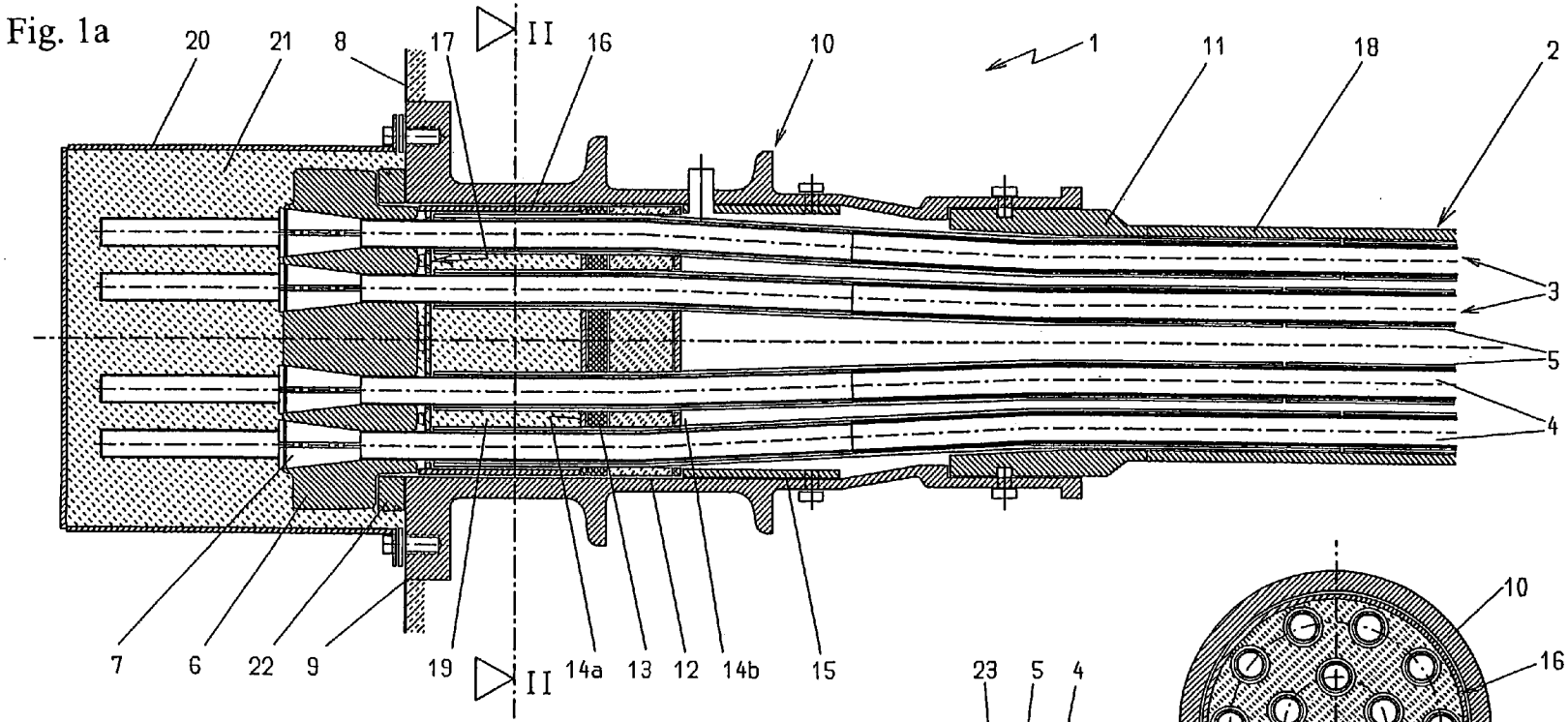
FIG. 1*a* is a longitudinal cross-section of an anchoring area of a tension member of according to a preferred embodiment of the present invention.
Figure 2:
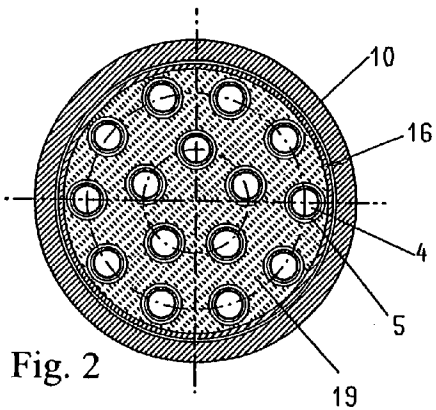
FIG. 2 is a cross-sectional view along line II—II in FIG. 1.

In FIG. 1*a*, the anchoring area 1 of a tension member 2 of this invention is illustrated in a longitudinal section. In the illustration, the tension member 2 is a tendon, which, as shown in FIG. 2, can be formed of fifteen individual tension elements 3. The tension elements 3, in turn, are formed of, for example, monostrands, that is, steel wire strands 4, which are surrounded by sheaths 5 made of plastic, particularly PE (poly ethylene), to protect against corrosion. The spaces between the individual wires (not shown) of the strands 4 and the PE sheath 5 are filled in with a corrosion-resistant material, for example, grease.

Figure 1B:
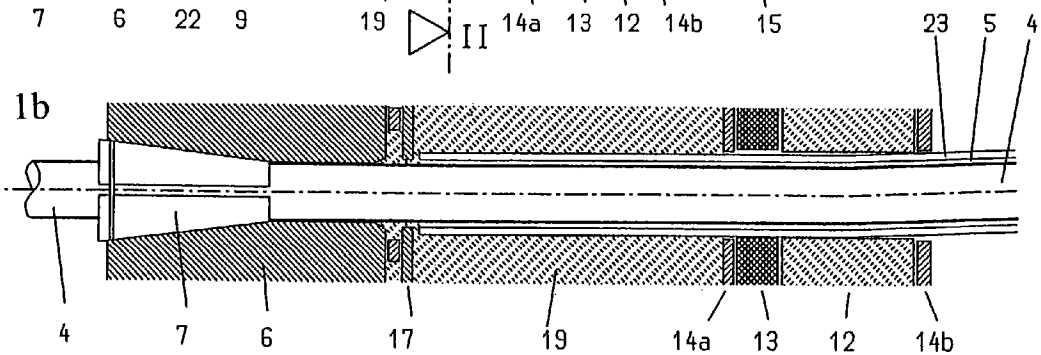
FIG. 1*b* is an enlarged illustration of a portion of the anchoring area of FIG. 1*a;*

The strands 4 are anchored to a steel anchor plate 6 by multi-part ring wedges 7. For this purpose, the anchor plate 6 has bores with an inner cylindrical area, which on its exposed side extends into a conical area (FIG. 1*b*).

On the outer surface 8 of a structure, the anchor plate 6 is supported, via an intermediate ring 22, against a flange-like abutment ring 9 of a tube-shaped anchor body 10, which is cemented into the structure. In the anchoring area 1, the anchor body 10 forms the tube-shaped sheathing of the bundle of tension elements 3, which can extend into an additional sheathing 18, if necessary, via an adaptor 11. For the sheathing 18, smooth or profiled PE tubes, metal tubes, etc. can be used. The adaptor 11 is made of plastic, most often of PE; it serves at the same time as a soft redirect for the tension elements 3.

Whereas the structure of a tension member such as described above is basically known, the invention relates foremost to the connection of the previously applied corrosion protection of the tension element 3 to the anchoring, since in the actual anchoring area the PE sheaths 5 of the tension elements 3 must be removed so that the wedges 7 can directly grip the bare strands 4.

Whereas the tension elements 3, being tightly packed in the normal area of the tension member 2 between the anchoring areas 1, are spread towards the outside in the area of the adaptor 11 to put them at a distance necessary for anchoring with the ring wedges 7 in the area of the anchor plate 6, they are, when entering the actual anchoring area, redirected towards a longitudinal axis of the tension member by a perforated disk 12 serving as a spacer. The perforated disk 12, which can be made of plastic and has suitable bores, is dimensioned in such a way that the tension elements 3 are guided parallel to axes of the wedges 7, thereby absorbing the reversing forces, which are thus created and which are directed radially to the longitudinal axis.

In turn, the perforated disk 12 serves as an abutment for a sealing plate 13 that can be made of soft rubber of foamed material, and can be put under surface pressure by using a steel pressure plate 14*a*. To be able to exert such pressure, the perforated disk 12 must be safeguarded against longitudinal displacement. In the illustrated embodiment, this is achieved with a stopper pipe 15, which butts against the interior wall of the anchor body 10, and which, for example, is secured with screws. However, safeguarding against longitudinal displacement can only be achieved when a suitable stop is formed on the interior wall of the steel-cast anchor body 10.

To achieve a fixing of the perforated disk 12 and a three-axial state of tension, an additional steel plate 14*b* can be arranged on the side of the perforated disk 12 that faces away from the anchor plate 6, analogous to the pressure plate 14*a*. This steel plate 14*b* simultaneously supports the perforated disk 12 during the absorption of the reversing forces.

To exert an axial pressure to the sealing plate 13 via the pressure plate 14*a*, a pressure tube 16 is used, which surrounds the entire assembly of tension elements 3 within the anchor body 10 and which is longitudinally slidable in relation to the anchor body. The length of this pressure tube 16 is calculated in such a way that it projects beyond the outer surface of the abutment ring 9 by the size of the compacted sealing plate 13 at installation of the anchoring. As a result of the positioning of the anchor plate 6 during the tensioning process, it is pressed against the sealing plate 13, whereby the sealing plate is compacted accordingly. Due to an activation of a transverse deformation of the sealing plate 13, the hollow space inside the anchor body 10 is sealed off to the PE sheaths 5 of the strands as well as to the inner wall of the anchor body 10.

In addition, as a result of the chosen arrangement of the pressure plate 14*a*—sealing plate 13—perforated disk 12, and steel plate 14*b* as the case may be, as well as the dimensioning of the perforated disk 12, the disadvantage frequently occurring with conventional anchorings is avoided, namely, that the tension elements 3, particularly when arranged out of order, become dislocated in a transverse direction during the tensioning process thus causing leakages.

To keep the PE sheaths 5 of the strands 4 from penetrating the bores of the anchor plate 6 in front of the wedges 7 during the installation or tensioning processes, thus possibly blocking the subsequent interposition with corrosion-resistant material, a retensioning plate 17 made of steel is arranged on the inside of the anchor plate 6. This retensioning plate 17 has bores, which just allow passage of the bare strands 4, whereas the PE sheaths 5 surrounding the strands are held back by a stop on the retensioning plate 17 (FIG. 1*b*).

In order not to block the subsequent interposition of the hollow spaces with corrosion-resistant material, the retensioning plate 17 must be kept at a certain, although marginal distance from the interior of the anchor plate 6 by spacers.

It is beneficial to provide the retensioning plate 17 with additional bores so that the corrosion-resistant substance can penetrate the bores of the anchor plate 6 and the slits between the parts of the ring wedges to insure reliable protection of the strands 4 from corrosion.

Figure 3:
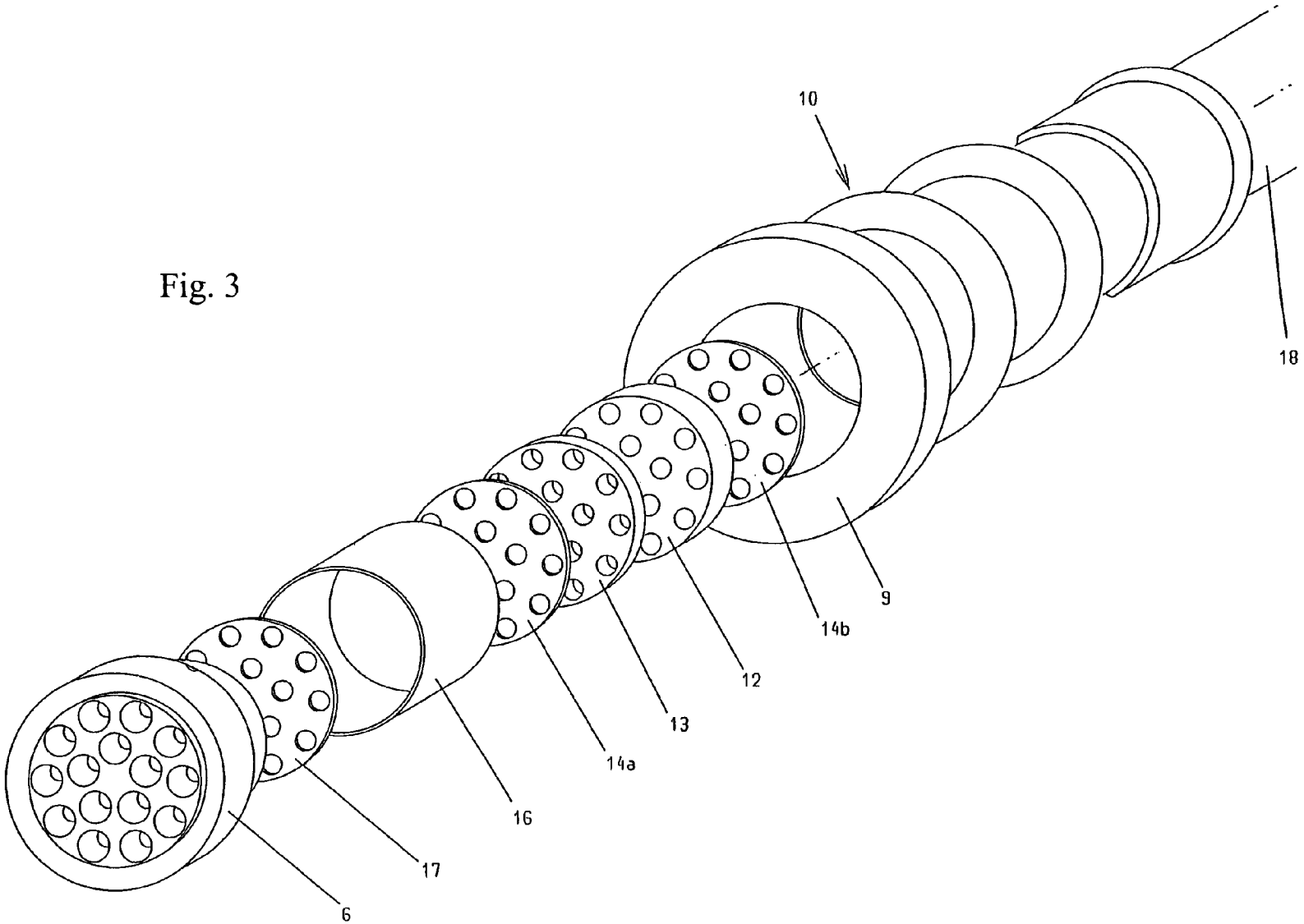
FIG. 3 is a diagram illustrating individual parts of the anchoring.

Installation of the anchoring structure of this invention is illustrated in FIG. 3. At a structure-side installation of the tension member 2, the anchor body 10 is connected to a sheathing 18 that is cut to a suitable length and installed in the encasing of the corresponding concrete structure. The tension elements 3, that is, the strands 4 surrounded by PE sheaths 5, are pulled or pushed in in a conventional fashion before or after the mortar is added.

To guarantee the desired exchangeability of the strands in the area of the seal, the individual strands 4 are surrounded by tubes 23 in the area of the sealing plate 13, which insure the sealing off to the outside but at the same time allow the strands to be pulled through. With simple extruded strands, telescopic tubes can be slid onto the strands' ends from the open air side, which penetrate the sealing plate 13. In either case, the tubes 23 find an abutment on the retensioning plate 17 (FIG. 1*b*).

When twice-extruded strands are used, that is, strands with two PE sheaths, a certain length of the outer PE sheath must be separated and removed from the end of the strand on the clamping side. Part of the inner PE sheath is then removed so that after tensioning, it ends in the area 19 of the anchoring, which is to be filled in with corrosion-resistant material. The outer PE sheath that was previously removed is re-attached and trimmed to a length such as to integrate it at installation with the area 19, which is to be filled in with corrosion-resistant substance.

After all strands are installed, the perforated disk 12, or, if necessary, before the steel plate 14*b*, the sealing plate 13, the pressure plate 14*a* and the pressure tube 16 as well as the retensioning plate 17 are installed. Due to the fact that all these parts only have to be slid onto the tension elements 3 and into the anchor body 10, no screwing processes are necessary, which allows a simple and time-saving installation. Further simplification of the installation can be achieved by combining the pressure plate 14*a* and the pressure tube 16 in a pot-shaped unit. Lastly, the anchor plate 6 is threaded onto the protruding ends of the strands.

In this state of installation, the anchor plate 6, which extends somewhat into the anchor body 10, and thus finds a guide on its inner wall, is positioned at a slight distance to the abutment ring 9, however, its inner surface rests against the pressure tube 16, which in turn presses onto the pressure plate 14*a*. This distance corresponds with the compactability of the sealing plate 13, which is being activated in this way, when the anchor plate 6 penetrates the anchor body 10 during the tensioning of the strands 4 at a corresponding distance until it stays on the abutment ring 9—with insertion of an intermediate spacer 22.

After tensioning the tension elements 3 through the bores in the anchor plate 6, through which an injection tool can be inserted, the interposition of the hollow space 19 between the sealing plate 13 and the anchor plate 6 with corrosion-resistant material is then carried out in a conventional manner. Lastly, the abutment ring 9 of the anchor body 6 is provided with a cover 20 so that by pressing in corrosion-resistant material, the anchor plate 6 with the wedge anchorings of the strands 4 are also protected against corrosion.

The tension channel, that is, the hollow space between the tension elements 3 and the sheathing 18, usually remains unobstructed to simplify a possible replacement of individual strands and/or the entire bundle. If a fill-in is desired, in order to avoid penetration of water, for example, a non-hardening material, for example, bentonite, or a material with a low degree of hardening, for example, mortar mixed with a plastic additive, for example, polystyrene, which is easily removed if need be, can be pressed in. For this purpose, conventional venting and injection openings are provided in the anchor body 10. In tension channels without fillings, these openings can be used for water drainage.

The intermediate ring 22 arranged between the anchor plate 6 and the abutment ring 9 is used when individual strands are being replaced, which necessitates a tension decrease, to avoid a dual wedge grip during the retensioning of the strands. The thickness of the intermediate ring 22, which is removed prior to the retensioning of the strands, corresponds with the distance of the "new" wedge grip as compared to the "old" wedge grip. In this case, to reactivate the seal through the sealing plate 13, an anchoring pipe 16 shortened by the thickness of the intermediate ring 22 is installed.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A corrosion-resistant tension member comprising:

a plurality of tension elements that are enclosed by a plastic sheath and are arranged inside a tube-shaped sheathing and have at ends thereof anchoring devices;

an anchor plate that has a plurality of bores formed therein for enabling the passage of each of the tension elements there through; and at least one sealing plate being provided on a side of the anchor plate that is opposite an open air side, the sealing plate being formed so as to enable the tension elements to pass there through, and to which a surface pressure can be applied, and behind which a perforated disk functioning as a spacer is arranged, wherein the sealing plate is fixedly placed against longitudinal displacement on the side facing away from the anchor plate and opposite the tube-shaped sheathing, wherein a pressure plate having the tension elements running through it, butts against a side of the sealing plate that faces the anchor plate, wherein a pressure-transferring means is provided between the anchor plate and the pressure plate, and wherein the length of the pressure-transferring means is such that the longitudinal displacement of the anchor plate that occurs during tensioning of the tension elements activates an exertion of surface pressure to the sealing plate.

2. The tension member according to claim 1, wherein the sealing plate, on the side facing away from the anchor plate, butts against the perforated disk, the perforated disk being fixedly placed opposite the tube-shaped sheathing against longitudinal displacement.

3. The tension member according to claim 2, wherein a steel plate butts against the perforated disk on the side facing away from the anchor plate, the steel plate being fixed in place opposite the tube-shaped sheathing against longitudinal displacement and forming an abutment for the perforated disk and the sealing plate.

4. The tension member according to claim 3, wherein stops are provided inside the tube-shaped sheathings for fixing the sealing plate and/or the perforated disk and/or the steel plate in place.

5. The tension member according to claim 4, wherein the stops are a stopper pipe.

6. The tension member according to claim 1, wherein the pressure-transferring means is at least one pressure tube.

7. The tension member according to claim 6, wherein the pressure tube has an outer diameter that is smaller than an inner diameter of the tube-shaped sheathing.

8. The tension member according to claim 7, wherein the pressure tube and the pressure plate are combined to form a pot-shaped unit.

9. The tension member according to one of claim 1, wherein stops for holding back a sheathing that surrounds the strands are provided in the anchor body.

10. The tension member according to claim 9, wherein the stops are formed by a retensioning plate having bores of a diameter, which correspond with an outer diameter of the strands with their sheathings removed.

11. The tension member according to claim 10, wherein the retensioning plate is supported against the anchor plate.

12. The tension member according to claim 11, wherein the retensioning plate is placed at a distance from the anchor plate.

13. The tension member according to claim 1, wherein the tension elements in the area of their passage through the sealing plate are guided individually and longitudinally slidable in tubes, against which the sealing plate is activated.

14. The tension member according to claim 13, wherein the tubes are supported against a retensioning plate.

15. The tension member according to claim 1, wherein the tendon is used in conjunction with prestressed concrete to facilitate anchoring of the tension elements.

16. The tension member according to claim 1, wherein the tension elements are formed of steel rods, steel wires, or steel strands.

17. A tendon comprising:

an anchor body for receiving a plurality of tension elements in a receiving end;

a spacer having a plurality of apertures formed therein, each of the apertures facilitating passage for each of the tension elements, the spacer being provided at an abutment end of the anchor body, the abutment end of the anchor body being substantially coaxial to the receiving end of the anchor body;

a sealing plate having a plurality of apertures formed therein, each of the apertures facilitating passage for each of the tension elements, the sealing plate being formed so as to deform upon application of a force; and an anchor plate for fixedly securing ends of the tension elements therein, the anchor plate providing the force to deform the sealing plate so that the apertures completely circumscribe a circumference of each of the tension elements.

18. The tendon according to claim 17, wherein the apertures of the spacer are formed so as to enable a redirection of the tension elements.

19. The tendon according to claim 17, wherein the sealing plate is provided between the anchor plate and the spacer.

20. The tendon according to claim 17, wherein the spacer, the sealing plate, and a portion of the anchor plate are formed so as to be received in the abutment end of the anchor body.

21. The tendon according to claim 17, wherein the anchor plate provides the sealing plate with the force to deform the sealing plate via a pressure tube, the pressure tube being provided between the anchor plate and the sealing plate.

22. The tendon according to claim 17, wherein a stop limits a longitudinal movement of the sealing plate within the anchor body in a direction of an application of the force.

* * * * *